US006732392B2

(12) United States Patent
Kay

(10) Patent No.: US 6,732,392 B2
(45) Date of Patent: May 11, 2004

(54) COMBINATION CORK EXTRACTOR AND FOIL CUTTER

(76) Inventor: Neil J. Kay, 16 Harbor Sight Dr., Rolling Hills Estates, CA (US) 90274

( * ) Notice: Subject to any disclaimer, the term of this patent is extended or adjusted under 35 U.S.C. 154(b) by 50 days.

(21) Appl. No.: 10/045,705

(22) Filed: Jan. 15, 2002

(65) Prior Publication Data

US 2003/0131420 A1 Jul. 17, 2003

(51) Int. Cl.[7] ..... B26B 11/00
(52) U.S. Cl. ..... 7/158; 81/3.09
(58) Field of Search ..... 7/158, 151, 167, 7/118, 155; 81/3.09, 3.44, 424.5, 3.07

(56) References Cited

U.S. PATENT DOCUMENTS 3,902,206 A * 9/1975 Naquin ..... 7/107
4,437,359 A * 3/1984 Dejoux et al. ..... 81/3.38
5,829,965 A * 11/1998 Rubalcava ..... 431/253
5,862,720 A * 1/1999 McNellis ..... 81/3.09
6,142,769 A * 11/2000 Walker ..... 431/253

FOREIGN PATENT DOCUMENTS

WO WO 9118822 * 12/1991 ..... B67B/7/18

* cited by examiner

*Primary Examiner*—Lee D. Wilson
(74) *Attorney, Agent, or Firm*—Irving Keschner

(57) ABSTRACT

A combination cork extractor and foil cutter comprising an elongated handle having first and second ends, a cork extractor being pivotably connected to the handle adjacent the first end thereof. An arcuate shaped member has first and second spaced apart accurate shaped portions positioned at the second end of the elongated handle. The first accurate shaped first portion is spring biased in a position whereby a space is formed between the first and second arcuate shaped portions. A first cutter is secured on the first arcuate shaped portion and a second cutter is secured on the second arcuate shaped portion. A protrusion is formed on the first arcuate shaped portion enabling a user to force the first and second arcuate shaped portions together thus engaging the foil wrapped around the neck of a bottle positioned therebetween.

5 Claims, 1 Drawing Sheet

COMBINATION CORK EXTRACTOR AND FOIL CUTTER

BACKGROUND OF THE INVENTION

1. Field of the Invention

The present invention provides a combination cork extractor and foil cutter wherein the cutter comprises two normally accurate shaped cutters, spring biased in the open position, an external member enabling a user to force the cutters toward each when the cutter is positioned over the neck of a wire bottle to cut the bottle foil.

2. Description of the Prior Art

U.S. Pat. No. 5,887,305 to Cellini discloses a combination cork extractor and foil cutter wherein the cutters comprise at least three shearing wheels defining two separate wheel assemblies, one wheel assembly being immovable, the other wheel assembly being movable.

The foil cutter disclosed in Cellini is relatively complex and expensive to fabricate since at least three separate shearing rollers are required. In addition, the user manually moves the shearing wheels to the closed position (when the foil cutter is in use) and then to the open position (to remove the foil cutter from the bottle), increasing the manual steps required of the user.

What is thus desired is to provide a combination cork extractor and foil cutter wherein the fabrication costs are reduced and wherein the cutter operation is simplified.

SUMMARY OF THE PRESENT INVENTION

The present invention provides a combination cork extractor and foil cutter device used to remove a cork from a wine bottle.

The device comprises an elongated handle having first and second ends, a cork extractor being pivotably connected to the handle adjacent the first end thereof. An arcuate shaped member has first and second spaced apart arcuate shaped positions are positioned at the second end of the elongated handle. The first arcuate shaped first portion is spring biased to a position whereby a space is formed between the first and second arcuate shaped portions. A first cutter is secured within the first arcuate shaped portion and a second cutter is secured within the second arcuate shaped portion, a protrusion being formed on the first arcuate shaped portion. In use, the first and second arcuate shaped portions are positioned over the bottle neck, the user then pressing the protrusion in a manner whereby the first arcuate shaped portion moves towards the second arcuate shaped portion thereby holding the bottle neck therebetween. The bottle is then rotated thus cutting the foil surrounding the bottle neck. After the foil is removed, the cork extractor is opened and used to remove the bottle cork in a conventional manner.

The device of the present invention thus provides a combination cork extractor and foil cutter which is easy to operate and which is relatively inexpensive to fabricate.

DESCRIPTION OF THE DRAWING

For a better understanding of the present invention as well as other objects and further features thereof, reference is made to the following description which is to be read in conjunction with the accompanying drawing therein.

DESCRIPTION OF THE INVENTION

Figure 1:
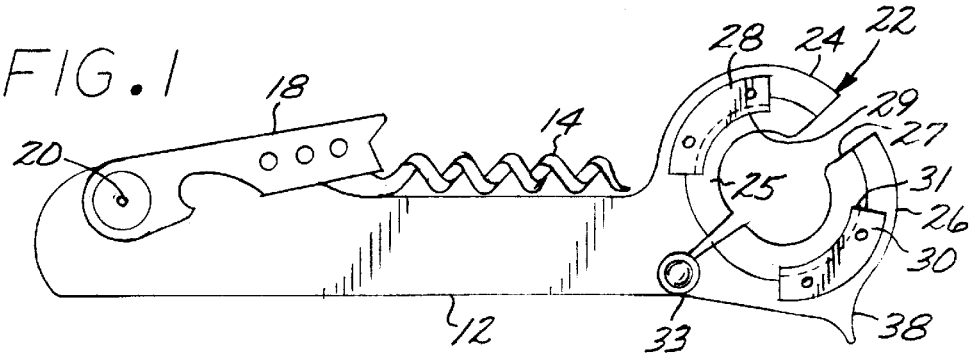
FIG. 1 is a front elevational view of the combination cork extractor and foil cutter of the present invention.
Figure 2:
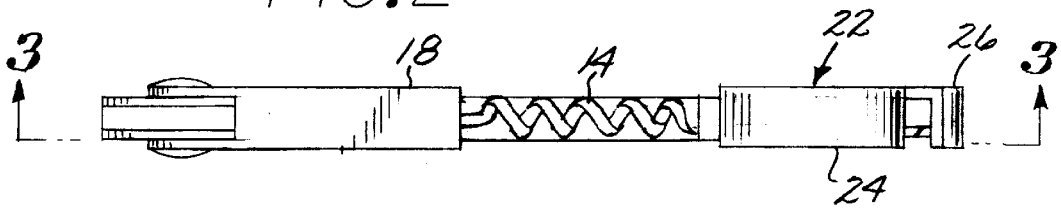
FIG. 2 is a top view of the device shown in FIG. 1.
Figure 3:
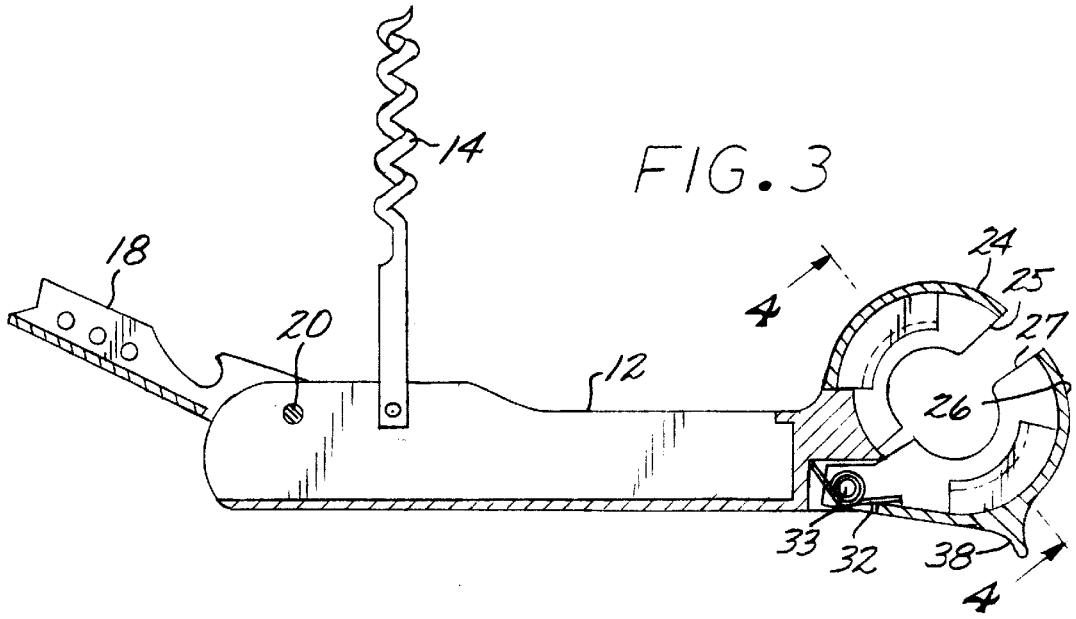
FIG. 3 is a view along line 3—3 of FIG. 2.
Figure 4:
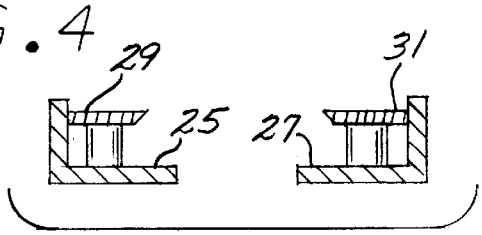
FIG. 4 is a cross-sectional view along lines 4—4 of FIG. 3.

Referring now to the figures, a combination cork extractor and foil cutter 10 of the present invention is illustrated. Combination 10 comprises a handle, or grip, portion 12, and a cork screw, or extractor 14, pivotably connected to grip 12 adjacent a first end of grip 12 about pin 20. Lever 18, provided to enable the cork to be removed, includes a portion 19 for removing a bottle cap if necessary. Formed on the other end of grip 12 is an arcuate shaped member 22 for cutting the foil formed on bottle necks, particularly on wine bottles. Arcuate shaped member 22 comprises an arcuate shaped fixed portion 24 having lip portion 25 and an arcuate shaped moveable, or pivotable portion 26 having lip potion 27. Secured to the top surface of portion 24 is a first, partial arcuate shaped cutter 28 having a downwardly extending portion 29; secured to the top surface of portion 26 is a second, partial arcuate shaped cutter 30 having a downwardly extending portion 31.

Portion 26, and the cutter 30 supported thereon, is biased in the open position, as illustrated, by a spring 32 positioned about pivot pin 33. A thumb portion, or protrusion, 38 is formed on pivotable portion 26 to provide a mechanism for closing portions 24 and 26 about the neck of the wine bottle.

In use, while shaped member 22 is in the open position, the foil wrapped neck of a wine bottle is positioned between portions 24 and 26. The portions are then closed around the bottle neck portion by the user pressing thumb portion 38 in a manner to force portion 26 towards portion 24 against the bias of spring 32. The bottle is then rotated such that the sharp edges of cutter portions 29 and 31 act together to completely cut the foil. The pressure on thumb portion 38 is then released, spring 32 forcing portion 26 to its normally open position. The bottle and foil is removed and cork screw 14 then screwed into the bottle cork which is then removed in a conventional manner.

The present invention thus provides a simple and cost effective device for removing a cork from a bottle having a foil wrapped neck portion.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A device having a cork extractor and foil cutter, said foil cutter having open and closed portions comprising:

an elongated handle having first and second ends;

a cork extractor pivotably coupled to said elongated handle adjacent said first end;

a foil cutter comprising an arcuate shaped member formed at said second end of said elongated handle, said arcuate shaped member comprising first and second joined arcuate shaped portions, said first arcuate shaped portion being fixedly attached to said handle, said second arcuate shaped portion being pivotable relative to said first arcuate shaped portion; and a first arcuate shaped cutter member secured to said first arcuate shaped member, and a second arcuate shaped cutter member secured to said second arcuate shaped member, said second arcuate shaped member being spaced apart from said first arcuate shaped member when said foil cutter is in the open position, resilient means maintaining the spaced apart position of said first and second arcuate members.

2. The device of claim 1 wherein said resilient means comprises a spring.

3. The device of claim 2 wherein force applied to said protrusion causes said second arcuate shaped member to move toward said first arcuate shaped member.

4. The device of claim 1 wherein a force applied to said second arcuate shaped member causes said second arcuate shaped member to move toward said first arcuate shaped member.

5. The device of claim 4 wherein a protrusion is formed on said second arcuate shaped member to receive said applied force.

* * * * *